US011174872B2

(12) United States Patent
Hill et al.

(10) Patent No.: US 11,174,872 B2
(45) Date of Patent: Nov. 16, 2021

(54) ANTI-SPIN PUMP DIFFUSER

(71) Applicant: HALLIBURTON ENERGY SERVICES, INC., Houston, TX (US)

(72) Inventors: Jason Eugene Hill, Bristow, OK (US); Joshua Wayne Webster, Sand Springs, OK (US); Wes John Nowitzki, Tulsa, OK (US); Casey Laine Newport, Tulsa, OK (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 244 days.

(21) Appl. No.: 16/347,178

(22) PCT Filed: Apr. 30, 2019

(86) PCT No.: PCT/US2019/029944
§ 371 (c)(1),
(2) Date: May 2, 2019

(87) PCT Pub. No.: WO2019/221907
PCT Pub. Date: Nov. 21, 2019

(65) Prior Publication Data

US 2020/0263703 A1 Aug. 20, 2020

Related U.S. Application Data

(60) Provisional application No. 62/671,568, filed on May 15, 2018.

(51) Int. Cl.
*F04D 29/44* (2006.01)
*E21B 43/12* (2006.01)
(Continued)

(52) U.S. Cl.
CPC ..... *F04D 29/44* (2013.01); *E21B 43/128* (2013.01); *F04D 1/06* (2013.01); *F04D 29/444* (2013.01);
(Continued)

(58) Field of Classification Search
CPC ..... F04D 13/10; F04D 29/628; F04D 29/448; F04D 13/086; F04D 1/06; F04D 29/167; F04D 29/22; F04D 29/622
See application file for complete search history.

(56) References Cited

U.S. PATENT DOCUMENTS 5,839,205 A 11/1998 Hung
6,726,449 B2 4/2004 James et al.
(Continued)

FOREIGN PATENT DOCUMENTS

WO WO 2018/148423 A1 8/2018

OTHER PUBLICATIONS

International Search Report and Written Opinion issued for International Patent Application No. PCT/US2019/029944, dated Aug. 7, 2019, 13 pages.

*Primary Examiner* — Dominick L Plakkoottam

(57) ABSTRACT

An electric pump may include a stack of diffusers including a first diffuser and a second diffuser. The first diffuser includes a recess therein defining an inner recess surface substantially circumscribing a primary diffuser axis. The second diffuser includes a lip projecting into the recess of the first diffuser. In response to a differential torque applied to the first and second diffusers about the primary diffuser axis, the lip of the second diffuser may engage the inner recess surface of the first diffuser, and thereby prevent relative rotation of the diffusers with respect to one another. An outer perimeter surface of the lip and the inner recess surface may define polygonal shapes or other non-circular profiles.

20 Claims, 11 Drawing Sheets

(51) Int. Cl.
*F04D 1/06* (2006.01)
*F04D 29/62* (2006.01)

(52) U.S. Cl.
CPC ..... *F04D 29/62* (2013.01); *F05B 2230/21* (2013.01); *F05B 2240/12* (2013.01)

(56) References Cited

U.S. PATENT DOCUMENTS

| | | | | |
|---|---|---|---|---|
| 8,043,051 | B2 | 10/2011 | Brunner | |
| 9,200,642 | B2 * | 12/2015 | Nowitzki | F04D 29/548 |
| 9,784,283 | B2 * | 10/2017 | Kao | F04D 1/06 |
| 2003/0185676 | A1 * | 10/2003 | James | F04D 1/063 415/199.2 |
| 2008/0286135 | A1 | 11/2008 | Yoshida et al. | |
| 2008/0292454 | A1 * | 11/2008 | Brunner | F04D 29/445 415/199.2 |
| 2017/0102009 | A1 * | 4/2017 | Johnson | F04D 29/628 |
| 2017/0248159 | A1 | 8/2017 | Rao et al. | |
| 2019/0085667 | A1 * | 3/2019 | Xiao | F04D 29/54 |
| 2019/0285071 | A1 * | 9/2019 | Webster | F04D 13/10 |

* cited by examiner

ANTI-SPIN PUMP DIFFUSER

CROSS REFERENCE TO RELATED APPLICATION(S)

This application is a U.S. national stage patent application of International Patent Application No. PCT/US2019/029944, filed on Apr. 30, 2019, which claims priority to U.S. Provisional Application No. 62/671,568 filed May 15, 2018, entitled "Anti-Spin Pump Diffuser," the disclosures of which are hereby incorporated herein by reference in their entirety.

TECHNICAL FIELD

The present disclosure relates generally to downhole electric submersible pumps in well drilling and hydrocarbon recovery operations, and more particularly, to pump diffusers with anti-spin mechanisms.

BACKGROUND

Hydrocarbons, such as oil and gas, are commonly obtained from subterranean formations that may be located onshore or offshore. The development of subterranean operations and the processes involved in removing hydrocarbons from a subterranean formation typically involve a number of different steps such as drilling a wellbore at a desired well site, treating the wellbore to optimize production of hydrocarbons, performing the necessary steps to produce the hydrocarbons from the subterranean formation, and pumping the hydrocarbons to the surface of the earth.

When performing subterranean operations, electric submersible pumps (ESPs) and/or surface pumps may be used when reservoir pressure alone is insufficient to produce hydrocarbons from a well. ESPs may be installed on the end of a tubing string and inserted into a completed wellbore below the level of the hydrocarbon reservoir. An ESP may employ a centrifugal pump driven by an electric motor to draw reservoir fluids into the pump and to the surface.

Such ESPs typically include one or more stages, each stage containing a rotating impeller and a stationary diffuser, whereby the impeller and diffuser combination of each stage is used to increase the velocity and pressure, respectively, of the hydrocarbon fluid as the fluid travels through the stage. In particular, a stage is arranged so that fluid exiting the outlet of the impeller enters the inlet of the adjacent diffuser, whereby the centrifugal force of the fluid exiting the impeller may be transferred to the diffuser, causing the diffuser to rotate or "spin" within the pump housing and decreasing the efficiency of the pump. To reduce the likelihood of diffuser spin, a compressive device may be used to apply an axial force to the diffuser. Diffuser spin is exacerbated as multiple stages are employed whereby diffusers are arranged in a stacked relationship. In such arrangements, the compressive device used to reduce spin becomes even less effective.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

The present disclosure describes a diffuser useful in a downhole electric submersible pump (ESP), a surface wellbore pump or other pumping applications. Modern petroleum production operations use ESPs or surface pumps to pump hydrocarbons from a reservoir to the well surface when the pressure in the reservoir is insufficient to force the hydrocarbons to the well surface. An ESP or surface pump may include one or more stages, each stage containing a rotating impeller and a fixed diffuser. The impeller and diffuser combinations may increase the velocity and pressure of the hydrocarbon fluid as the fluid travels through the stages of the ESP or surface pump. The impeller may accelerate the fluid to increase the velocity and kinetic energy of the fluid. The diffuser may transform the kinetic energy of the fluid into potential energy by increasing the pressure of the fluid. Impellers are typically mounted on and carried by the pump drive shaft, while diffusers are typically deployed within a pump housing of the ESP or surface pump along the inner housing wall.

Figure 1:
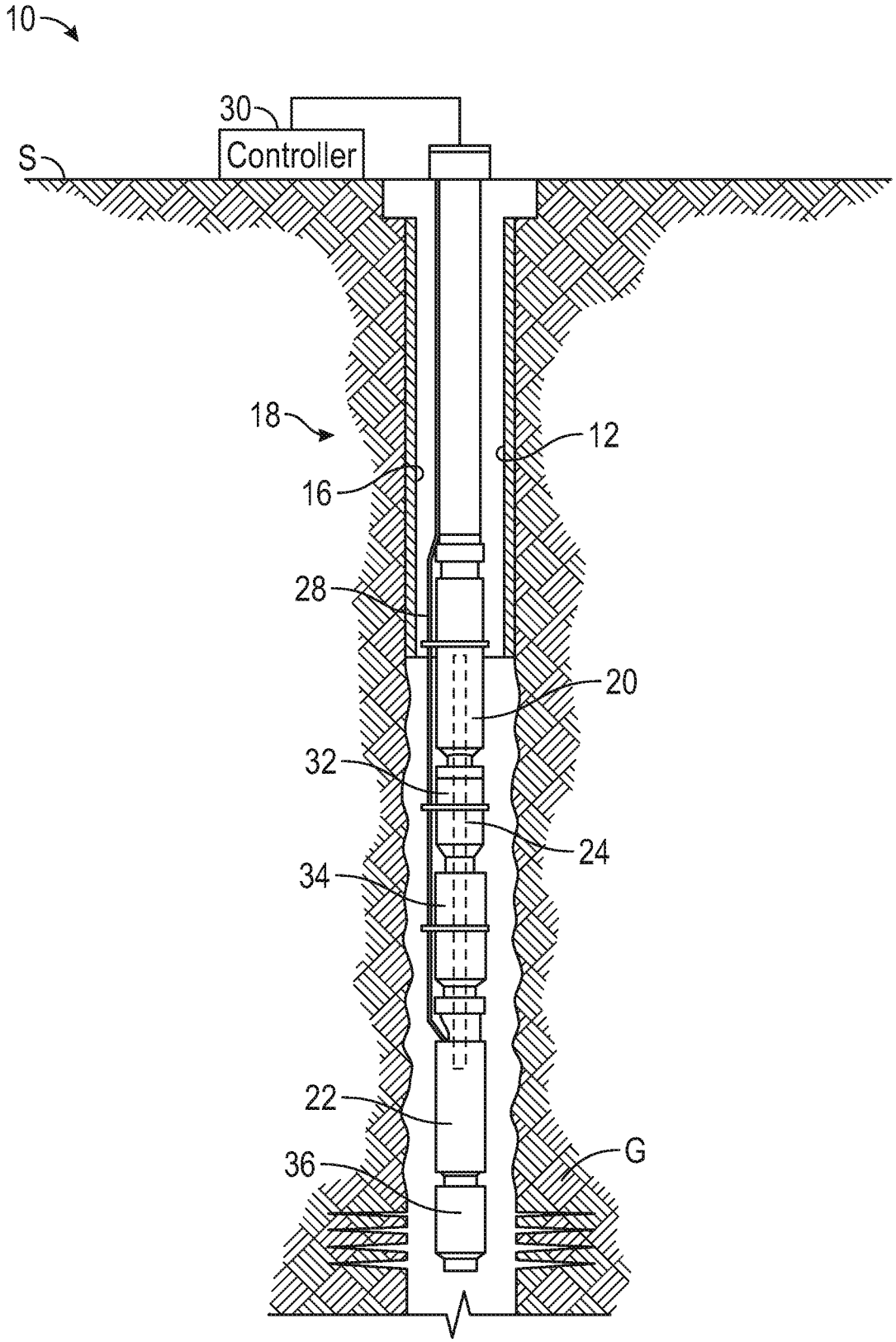
FIG. 1 is a partial cross-sectional side view a wellbore ESP system including a downhole centrifugal pump and a drive motor in accordance with embodiments of the present disclosure.

An example embodiment of a wellbore ESP system 10 in accordance with some embodiments of the present disclosure is illustrated in FIG. 1. The wellbore ESP system 10 is deployed in a wellbore 12 extending from a surface location "S" into a geologic formation "G." In the illustrated embodiment, the wellbore 12 extends from a terrestrial or land-based surface location "S." in other embodiments (not shown), the wellbore ESP system 10 may be employed satisfactorily in wellbores extending from offshore or subsea surface locations using with appropriate equipment such as offshore platforms, drill ships, semi-submersibles and drilling barges. The wellbore 12 defines an "uphole" direction referring to a portion of wellbore 12 that is closer to the surface location "S" and a "downhole" direction referring to a portion of wellbore 12 that is further from the surface location "S."

Wellbore 12 is illustrated in a generally vertical orientation. In other embodiments, the wellbore 12 may include portions in alternate deviated orientations such as horizontal, slanted or curved without departing from the scope of the present disclosure. Wellbore 12 optionally includes a casing string 16 therein, which extends generally from the surface location "S" to a selected downhole depth. Portions of the wellbore 12 that do not include casing string 16 may be described as "open hole."

Various types of downhole hydrocarbon fluids may be pumped to the surface location "S" with ESP 18 deployed in the wellbore 12. The ESP 18 may include a multi-stage centrifugal pump 20 that functions to transfer pressure to the hydrocarbon fluids (and/or other wellbore fluids present) to propel the fluids from a reservoir in the geologic formation "G" to the surface location "S" at a desired pumping rate. The ESP 18 also includes a motor 22, gas separator/intake module 32, a seal chamber 34 and an optional sensor package 36. ESP 18 may have any suitable size or construction based on the characteristics, e.g., wellbore size, desired pumping rate, etc., of the subterranean operation for which the ESP 18 is employed. The pump 20 of the ESP 18 may operate, e.g., by adding kinetic energy to the hydrocarbon fluids via centrifugal force, and convert the kinetic energy to potential energy in the form of pressure using one or more impellers and diffusers as discussed below in greater detail with reference to FIG. 2.

The ESP 20 includes a motor 22 for driving the one or more impellers in the centrifugal pump 20. A drive shaft 24 may operably connect the motor 22 to transmit the rotation of motor 22 to one or more impellers 38 (FIG. 2) located in pump 20 and thereby cause the impellers to rotate. The motor 22 may also be coupled by a cable 28 to a controller 30 at the surface location "S," which may provide instructions to the motor 22 for operating in a particular manner. In other embodiments, a controller may be disposed at a downhole location.

Other various components of the ESP 20 include the intake module 32, seal chamber 34, and sensor package 36. The intake module 32 may allow fluid to enter the bottom of ESP 20 and flow to the first stage of the ESP 20. Seal chamber 34 may extend the life of the motor 22 by, e.g., protecting the motor 22 from contamination, and providing pressure equalization between the motor 22 and the wellbore 12.

The motor 22 may operate at high rotational speeds, such as 3,500 revolutions per minute, to thereby drive the rotation of the impellers in the ESP 20. Rotation of the impellers may cause the ESP 20 to pump fluid to the surface location "S." The sensor package 36 may include one or more sensors used to monitor the operating parameters of the ESP 20 and/or conditions in the wellbore 12, such as the intake pressure, casing annulus pressure, internal motor temperature, pump discharge pressure and temperature, downhole flow rate, or equipment vibration. The sensor package 36 may be communicatively coupled to the controller 30.

Figure 2:
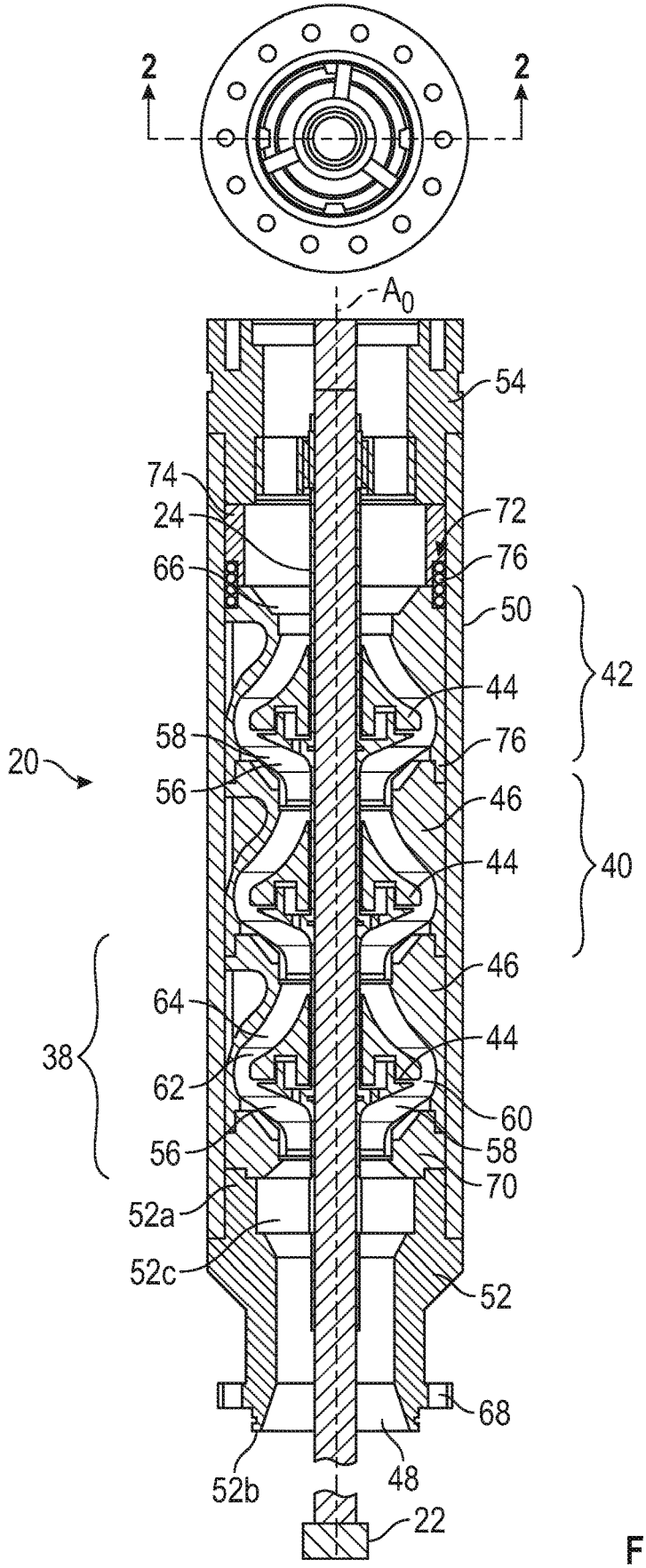
FIG. 2 is a cross-sectional view of the downhole centrifugal pump of FIG. 1 illustrating an anti-spin diffuser stack.

FIG. 2 illustrates a cross-sectional view of the pump 20. Pump 20 may include one or more pump stages, e.g., first stage 38, second stage 40, and third stage 42, depending on the pressure and flow requirements of the particular subterranean operation. Each stage 38, 40, 42 of pump 20 may include one or more impellers 44 and diffusers 46. Drive shaft 24 may transmit the rotation of motor 22 to the one or more impellers 44 carried on drive shaft 24 and located in pump 20 so as to cause the impellers 44 to rotate about longitudinal axis $A_O$ with respect to the diffusers 46. A pump intake 48 may allow fluid to enter the bottom of pump 20, e.g., from intake module 32 (FIG. 1), and flow to the first stage 38 of pump 20. As hydrocarbon fluid travels through pump 20, the pressure of fluid may generally increase at each stage 38, 40, 42 of a multi-stage pump 20 due to the fluid traveling through the diffusers 46.

In the illustrated embodiment, pump 20 may include drive shaft 24, impellers 44 and diffusers 46 housed within an elongated tubular pump housing 50. A lower pump intake mandrel 52 is coupled to a lower end of the pump housing 50 and an upper pump discharge mandrel 54 is coupled to an upper end of the pump housing 50.

Drive shaft 24 may be used to transfer rotational energy from the motor 22 to the rotational components of pump 20, such as the impellers 44. In this regard, the impellers 44 are mounted on and carried by drive shaft 24. Impellers 44 may be used to increase the velocity and kinetic energy of the fluid as the fluid flows through pump 20. The rotation of impellers 44 may cause the hydrocarbon fluid to accelerate radially outward from drive shaft 24 and increase the velocity of the fluid inside pump 20. In particular, fluid may enter the impellers 44 through an inlet eye 56 and pass over an impeller vane 58 or blade shaped to increase the velocity of the fluid. The impeller vane 58 forms an impeller passage for delivering the fluid to an impeller outlet 60. The increased velocity of the fluid may result in the fluid having an increased kinetic energy.

Upon exiting the impeller outlet 60, the fluid is delivered to a diffuser 46 disposed adjacent to the impeller 44 (together the impeller 44 and diffuser 46 forming a pump stage 38, 40, 42), and in particular, to the diffuser inlet 62, which directs the fluid to pass over a diffuser vane 64 or blade shaped to decrease the velocity of the fluid. The diffuser vane 64 forms a diffuser passage for delivering the fluid to a diffuser outlet 66.

The lower pump intake mandrel 52 has a first end 52*a* and a second end 52*b* with an inner bore 52*c* extending therebetween. The pump intake 48 is defined at the second end 52*b* of the lower pump intake mandrel 52. Lower pump intake mandrel 52 may include mounting flanges 68 extending laterally from an outer circumference thereof. Mounting flanges 68 may facilitate connection with a string of production tubing 14 (FIG. 1). A diffuser support ring 70 is disposed at the first end 52*a* of the lower pump intake mandrel 52. The diffuser(s) 46 forming the first stage 38 of the pump 20 may land on or otherwise about the support ring 70.

The diffusers 46 may be used to convert the kinetic energy (e.g., velocity) of the hydrocarbon fluid into potential energy (e.g., pressure) by gradually slowing the fluid, which increases the pressure of the fluid. The increased pressure of the fluid may cause the fluid to rise to the surface location "S" (FIG. 1). Diffusers 46 may increase the pressure of the hydrocarbon fluid by providing a continually increasing flow area as the fluid passes through diffuser 46 along the diffuser passage or flow channel formed by a diffuser vane 64 or blade. In this regard, the diffuser outlet 66 may have a larger cross-sectional area than the diffuser inlet 62.

The stages 38, 40, 42 of pump 20 may be connected in series to achieve a design output pressure of pump 20. While pump 20 is shown in FIG. 2 as having more than one stage 38, 40, 42 an ESP may also be constructed as a single-stage pump without departing from the scope of the disclosure. In FIG. 2, three stages 38, 40, 42 are illustrated. In the case of a multi-stage pump 20, the diffusers 46 may be deployed in series within the pump housing 50, whereby the downstream end of one diffuser 46 abuts the upstream end of an adjacent diffuser 46 to form a diffuser stack. In particular, as shown, a first diffuser 46 is disposed about the drive shaft 24 with a first impeller 44 disposed within the first diffuser 46, a second diffuser 46 is disposed about the drive shaft 24 and abutting the first diffuser 46 with a second impeller 44 disposed within the second diffuser 46, and a third diffuser 46 is disposed about the drive shaft 24 and abutting the second diffuser 46 with a third impeller 44 disposed within the third diffuser 46. As shown, the first end of one diffuser 46 engages the second end of the abutting diffuser 46.

After traveling through the multiple stages of PUMP 20, the fluid may exit PUMP 20 at the upper pump discharge mandrel 56 or discharge head. In some embodiments, the discharge mandrel 56 may be connected to production tubing 14 (FIG. 1), which may be used to direct the flow of fluid from the wellbore 12 to the surface location "S." Housing 50 may surround the components of PUMP 20 and may align the components of PUMP 20.

As the fluid exits the impeller outlet 60, the fluid may enter the diffuser inlet 62 of the surrounding diffuser 46. Diffuser 46 may convert the kinetic energy of the fluid into potential energy, which may increase the pressure of the fluid. The increased pressure of the fluid causes the fluid to rise to the surface location "S." However, a portion of the kinetic energy arising from the centrifugal force may be transferred to the diffuser 46, urging the diffuser 46 to rotate relative to the pump housing 50 in which the diffuser 50 is mounted. A compression mechanism 72 may be utilized to apply axial force to the diffuser 46 to counteract the centrifugal force applied to the diffuser 46 by the fluid. The compression mechanism 72 may include a compression sleeve 74 and a spring 76. However, as the kinetic energy of the fluid is increased, the compression mechanism 72 alone may not be sufficient to counteract the centrifugal force applied to diffuser 46. This is particularly true where multiple diffusers 46 are deployed in a stack within a housing 50.

Figure 3A:
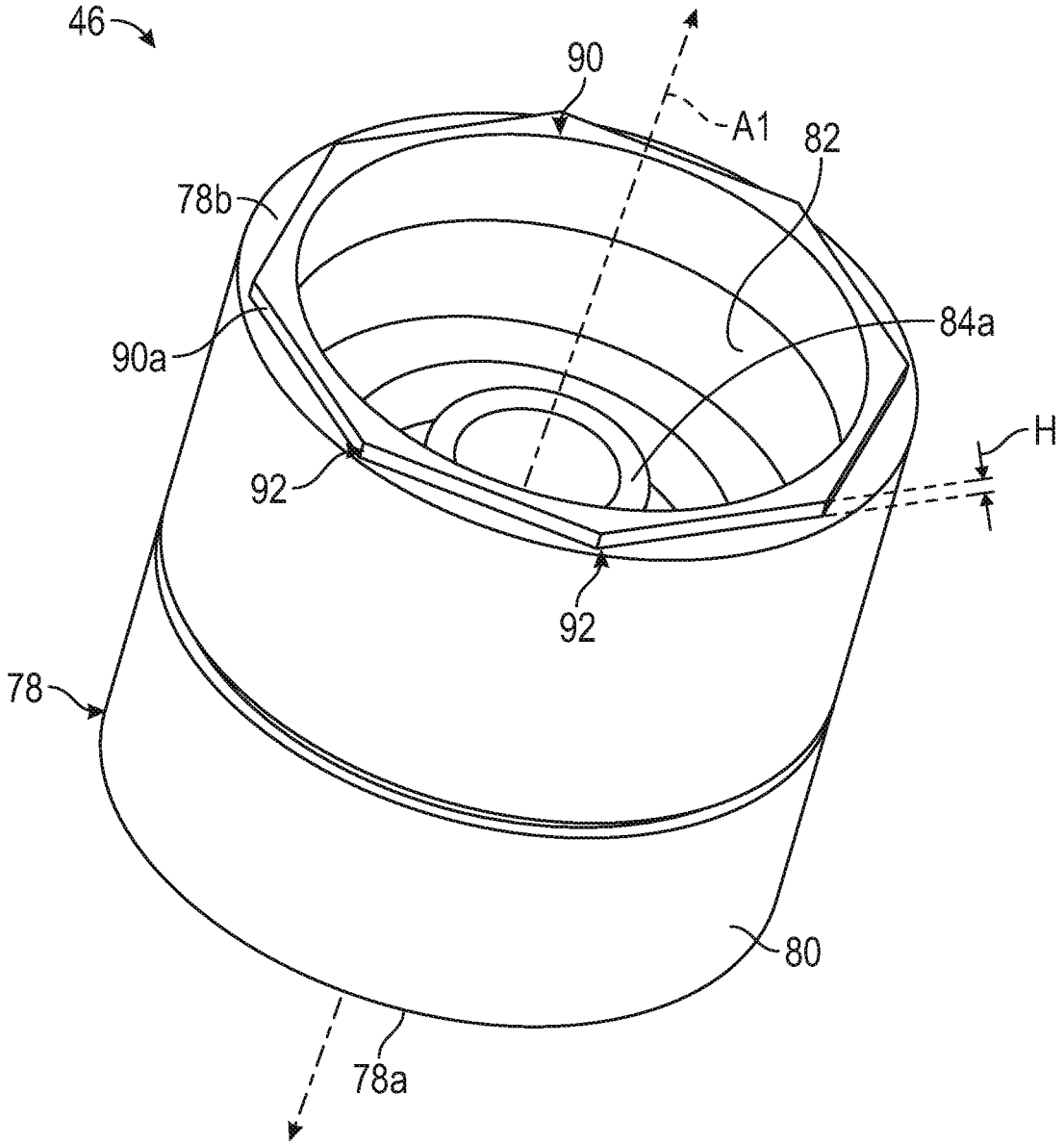
FIGS. 3A and 3B are respective top isometric and bottom isometric views of one embodiment of a single diffuser of the diffuser stack of FIG. 2.
Figure 3B:
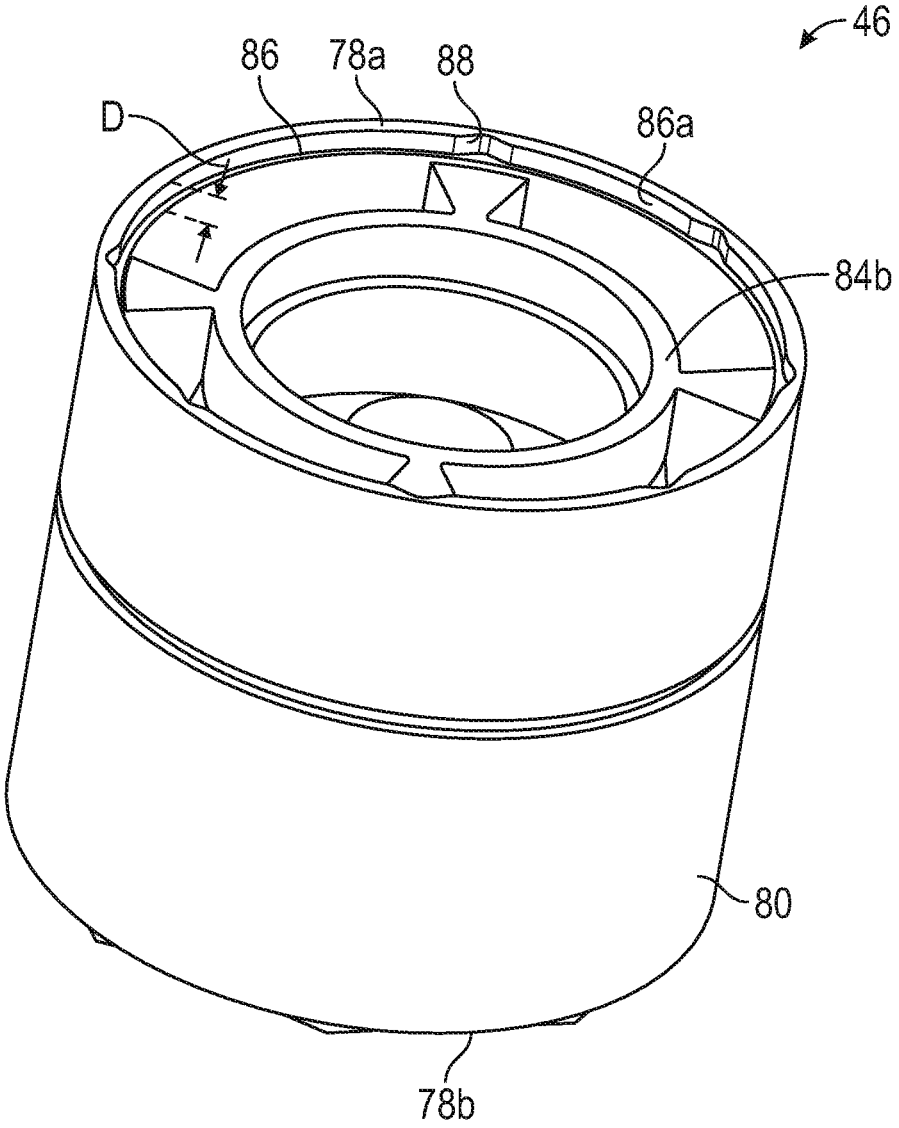

FIGS. 3A and 3B are isometric views of a diffuser 46, in accordance with some embodiments of the present disclosure. Diffuser 46 may be a component of a stage 38, 40, 42 of an ESP, such as ESP 20 shown in FIG. 2. A diffuser 46 may include a cylinder 78 extending along a primary diffuser axis $A_1$. Cylinder 78 is formed of a tubular wall 80 with a through bore 82 extending between a first cylinder end 78*a* and a second cylinder end 78*b*. Axially disposed within the cylinder 78 is one or more sleeves 84*a*, 84*b*. Multiple sleeves 84*a*, 84*b* of different diameters may be concentrically arranged. One or more diffuser vanes 64 (FIG. 2) or blades extend between the sleeve 84*b* and the tubular wall 80 of the cylinder 78. The vane 64 may have a helix shape and extend about the primary diffuser axis $A_1$. In embodiments with multiple sleeves 84*a*, 84*h*, an inner sleeve 84*a* may form a hub and vanes 64 may extend between the hub and an outer sleeve 84*b*. While several arrangements of the interior portion of a diffuser 46 are described, the disclosure is not limited by the arrangement of vanes 64 and sleeves 84*a*, 84*b* within the diffuser 46.

Formed in the first cylinder end 78*a* is a recess 86. The recess 86 is characterized by an inner recess surface 86*a* circumscribing the primary diffuser axis $A_1$. The recess 86 may be an interior portion of the tubular wall 80 forming the cylinder 78 and in this regard, the inner recess surface 86*a* may be an inner side of the tubular wall 80 forming the cylinder 78. In any event, a recess orientation feature 88 is formed along the inner recess surface 86*a*. In one or more embodiments, the disclosure is not limited by the shape or number or relative positioning of the recess orientation features 88. In one or more embodiments, the recess orientation feature 88 may be a shaped relief, such as a notch, slot or other void. In this regard, an angular notch may be formed by the intersection of two flat portions of the inner recess surface 86*a*. In one or more embodiments, the inner recess surface 86*a* may generally be a circular wall with one or more angular notches formed as spaced apart intervals around the periphery of the circular wall. In one or more embodiments, a plurality of recess orientation features 88 may be provided. These recess orientation features 88 may have the same or differing shapes. These recess orientation features 88 may be symmetrically or asymmetrically disposed along the inner recess surface 86*a* and about primary diffuser axis $A_1$. For example, if two orientation features 88 are provided, the orientation features 88 may be spaced apart from one another 180 degrees from one another about the primary diffuser axis $A_1$.

A lip 90 projects axially from the second end 78*b* of the cylinder 78. Generally, the lip 90 may be formed of a wall having an outer surface 90*a* and an inner surface 90*b* circumscribing the primary diffuser axis $A_1$. Formed along the outer surface 90*a* of the lip 90 are one or more lip orientation features 92. In one or more embodiments, the disclosure is not limited by the shape or number or relative positioning of the lip orientation features 92. In one or more embodiments, the lip orientation feature 92 may be a shaped protrusion, such as a corner or key or other device. In this regard, a corner may be formed by the intersection of two flat portions of the outer surface 90*a* of the lip 90. In one or more embodiments, the outer surface 90*a* may generally be a circular wall with one or more angular corners formed at spaced apart intervals around the periphery of the circular wall. In one or more embodiments, a plurality of lip orientation features 92 may be provided. These lip orientation features 92 may have the same or differing shapes. These lip orientation features 92 may be symmetrically or asymmetrically disposed along the perimeter of the outer surface 90*a* of the lip 90. For example, if two lip orientation features 92 are provided, the orientation features may be spaced apart from one another 180 degrees from one another about the primary diffuser axis $A_1$. In embodiments illustrated in FIGS. 3A and 39, the outer surface 90*a* has eight (8) flat surfaces forming a polygon with eight (8) lip orientation features 92 or corners defined by adjacent intersecting surfaces while the recess 86 has eight (8) recess orientation features 88 or angular notches disposed along and extending radially outward from the generally circular shaped inner recess surface 86*a* or wall.

In one or more embodiments, the recess 86 has a depth D from the outer edge to the base of the recess, and the lip 90 has a height H from the outer edge of the lip 90 to the base of the lip 90, wherein the lip height H is less than the recess depth D so that the outermost edge of the lip 90 does not abut or contact the base of the recess 86. As such, any interference created by the lip and recess when engaged is only radial to prevent spin of interlocking diffusers.

Figure 4A:
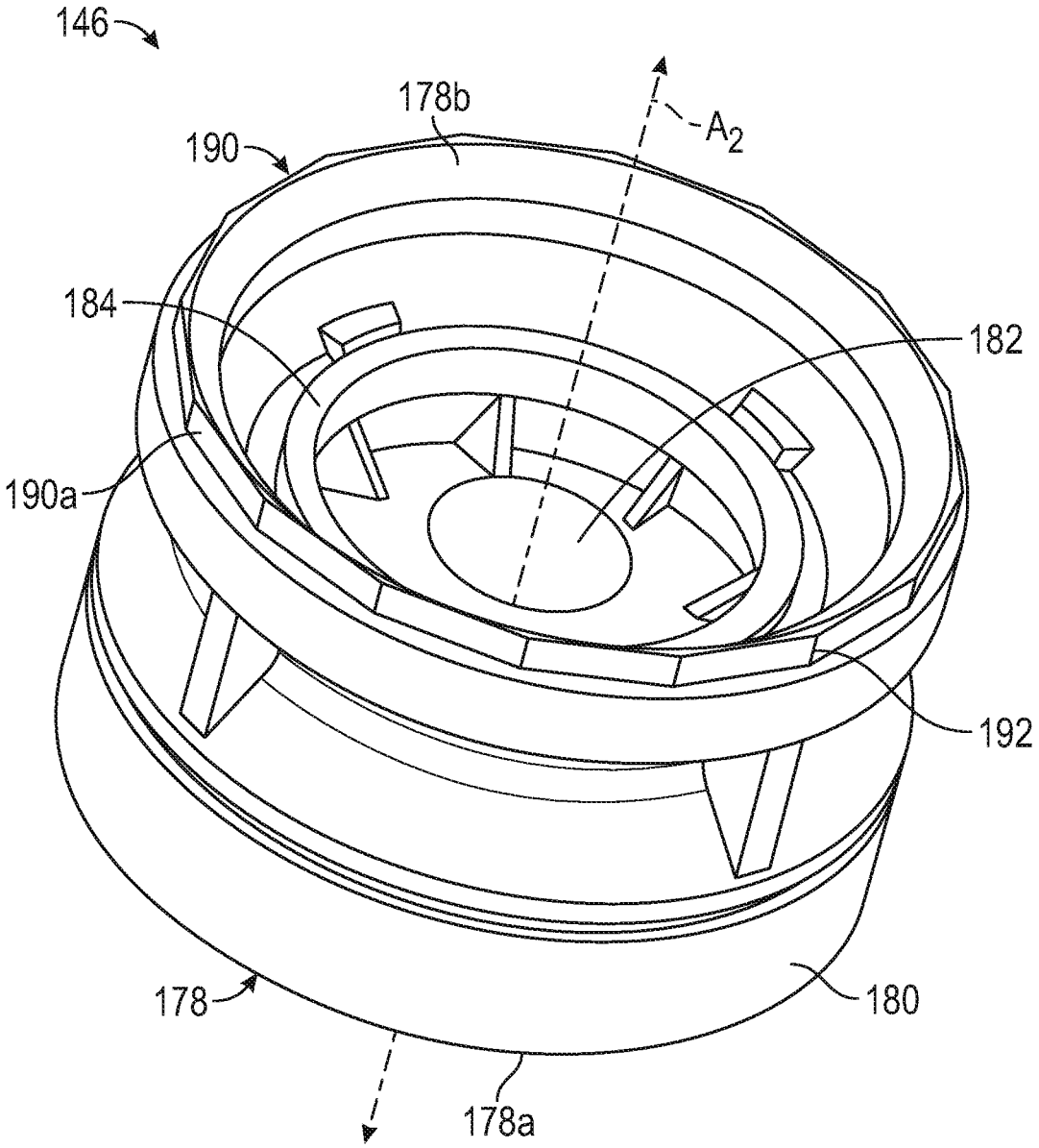
FIGS. 4A and 4B are respective top isometric and bottom isometric views of another embodiment of a single diffuser that may be stacked in a manner similar to the diffuser stack of FIG. 2.
Figure 4B:
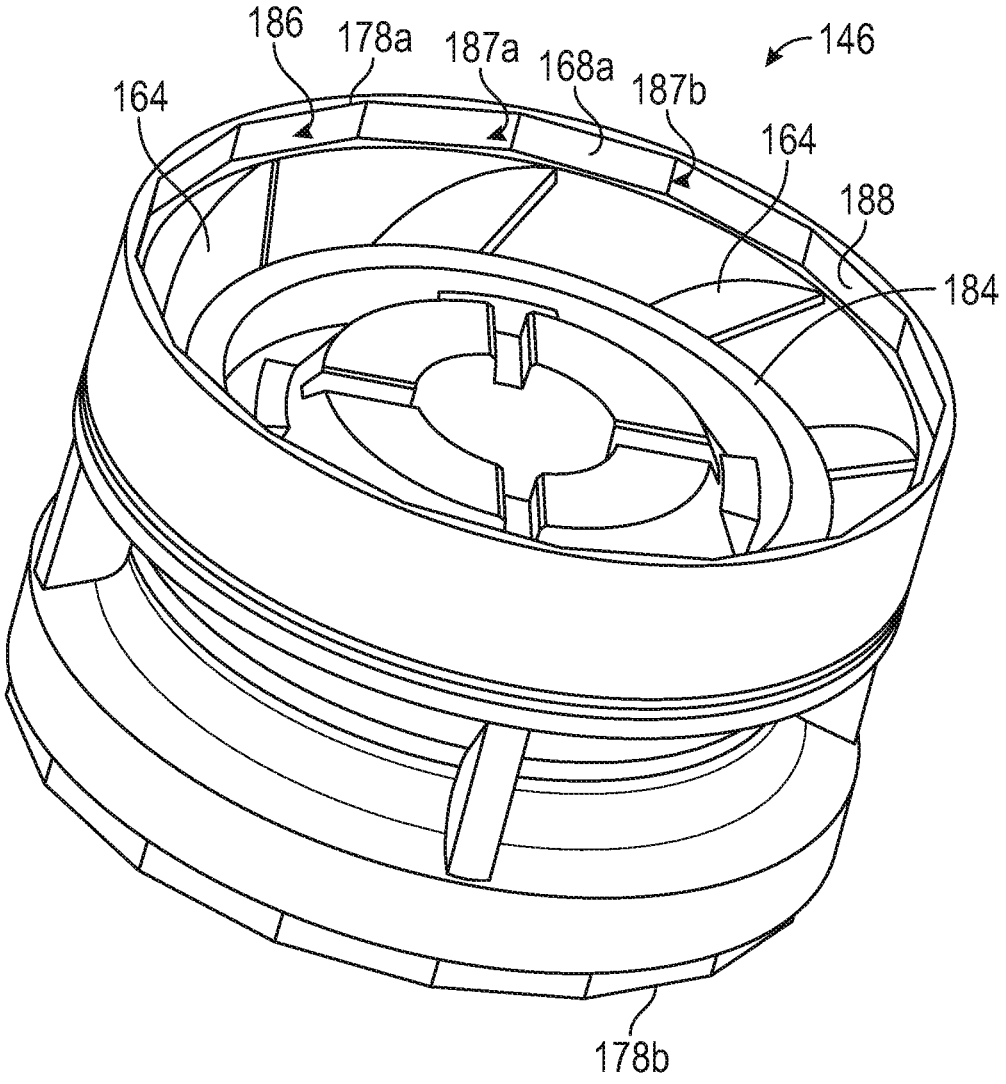

FIGS. 4A and 4B, are isometric views of a diffuser 146, in accordance with some other embodiments of the present disclosure. Diffuser 146 includes a cylinder 178 extending along a primary diffuser axis $A_2$. Cylinder 178 is formed of a tubular wall 180 with a through bore 182 extending between a first cylinder end 178*a* and a second cylinder end 178*b*. Axially disposed within the cylinder 178 is one or more sleeves 184 supporting diffuser vanes 164, which may be helically arranged about the about the primary diffuser axis $A_2$.

A recess 186 is formed in the first cylinder end 178*a* and is characterized by a circumferential inner recess surface 186*a* fully or substantially circumscribing the primary diffuser axis $A_2$. As illustrated, the circumferential inner recess surface 186*a* is generally parallel to the primary diffuser axis $A_2$. In other embodiments (not shown), a circumferential recess surface may be taper inward from a first cylinder end toward the primary diffuser axis $A_2$. The circumferential inner surface 186*a* defines a non-circular profile including sixteen (16) flat faces 187*a* forming a polygon with sixteen (16) corners 187*b* defined by adjacent intersecting flat faces 187*b*. It will be appreciated that in the case of a polygonal recess 186, the larger the diameter of the diffuser 146 the greater the number of flat surfaces 187*a*. The flat faces 187*a* may be considered recess orientation features 188 since a lip 190 of an adjacent diffuser 146 may engage the flat faces to maintain a rotational orientation between the adjacent diffusers 146.

The lip 190 projects axially from the second end 178*b* of the cylinder 178. Generally, the lip 190 may be formed of a wall having an outer surface 190*a* and an inner surface 190*b* fully or substantially circumscribing the primary diffuser axis $A_2$. The circumferential outer surface 190*a* defines a non-circular profile including sixteen (16) flat faces 191*a* forming a polygon with sixteen (16) corners 191*b* defined by adjacent intersecting flat faces 191*b*. The lip 190 may be received into the recess 186 of an adjacent diffuser 146 in a diffuser stack (see FIG. 2) such that a rotational orientation between the diffusers 146 may be maintained. When a differential torque is applied between the adjacent diffusers 146, the corners 191*h* of the lip 190 may engage the flat faces 187*a* of the recess 186 to prevent relative rotation between the adjacent diffusers 146*a*. Thus, the corners 191*b* may be considered lip orientation features 192 corresponding to the recess orientation features 188.

In each of the diffusers shown in FIGS. 3A, 3B, 4A and 4B, it will be appreciated that the manufacture of the diffusers 46, 146 is significantly simplified by utilizing orientation features 88, 92, 188, 192 that can be readily cast during fabrication of the diffuser 46, 146. Moreover, the lip 90, 190 and recess 86, 186 arrangement can be employed without adding additional length to standard diffusers.

Notwithstanding the foregoing, it will be appreciated that the lip outer perimeter surface 90*a*, 190*a* may be shaped to correspond to the shape of the inner surface 86*a*, 186*a* of the recess 86, 186 so that in the instance of stacked diffusers 46, 146, the recess 86, 186 at the first end 78*a*, 178*a* of a first diffuser 46, 146 can receive the lip 90, 190 at the second end 78*b*, 178*b* of a second diffuser 46, 146. In this regard, the lip 90, 190 and recess 86, 186 may have any shape so long at the shapes are non-circular but selected to permit the lip 90, 190 to seat within the recess 86, 186, thereby interlocking the two abutting diffusers 46, 146 together. It will be appreciated that so long as the shapes are non-circular, interference between the outer lip wall 90*a*, 190*a* and the inner recess surface 86*a*, 186*a* will prevent two abutting diffusers 46, 146 from rotating relative to one another under the application of a centrifugal force.

Figure 5:
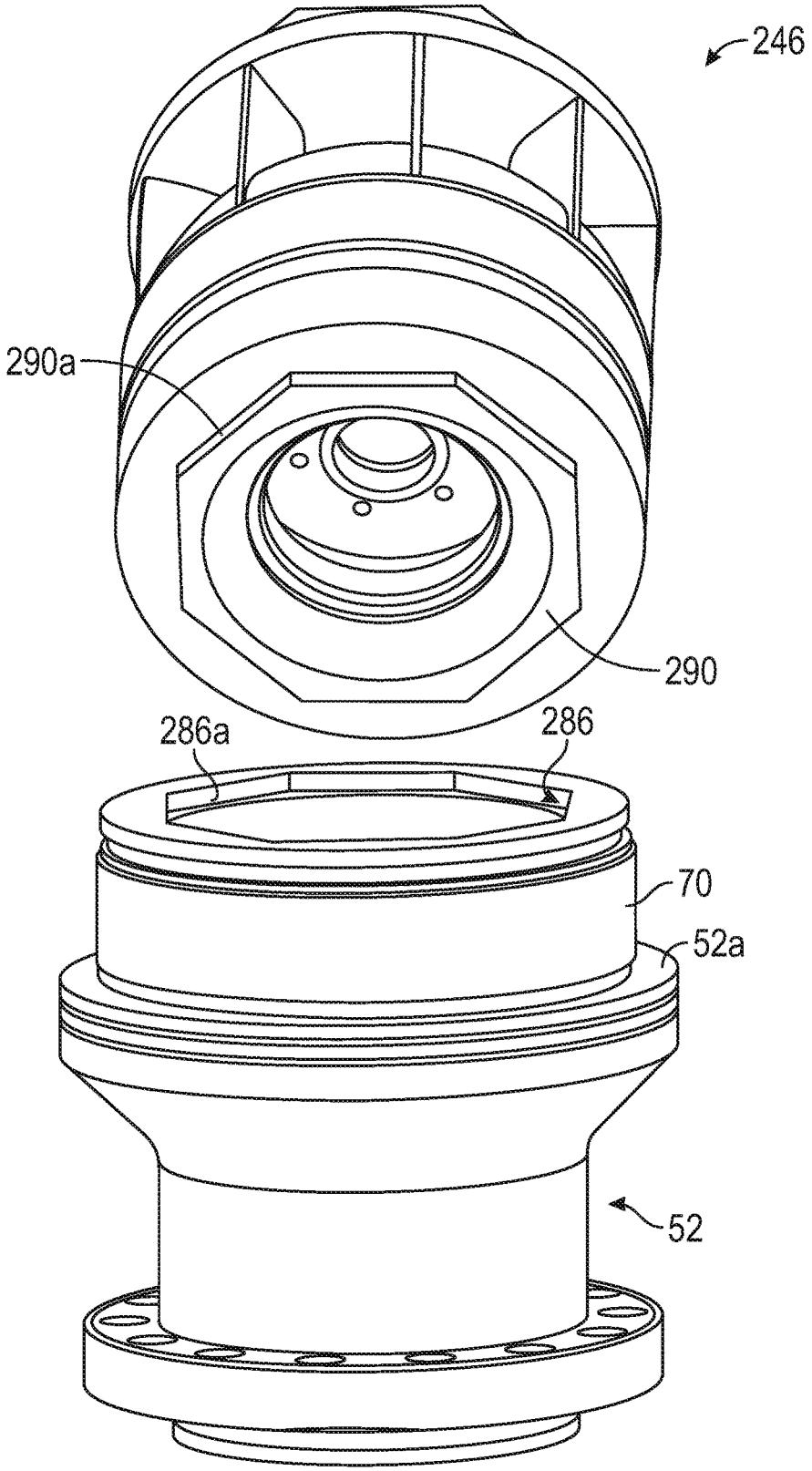
FIG. 5 is an isometric view of a diffuser adjacent a diffuser support ring of a lower pump intake mandrel.

With reference to FIG. 5, a diffuser 246 is shown being engaged with the lower pump intake mandrel 52. In particular, it can be seen that diffuser support ring 70 disposed at the first end 52*a* of the lower pump intake mandrel 52 and includes a recess 286 formed by the diffuser support ring 70. The recess 286 of the diffuser support ring 70 is shaped, as described above, to have a non-circular profile similarly to the recesses 86, 186 of the diffusers 46, 146 so as to be disposed to receive a lip 290 of the diffuser 246. An outer surface 290*a* of the lip 290 is arranged to engage the inner surface 286*a* of the recess 286 and thereby prevent relative rotation of the lower stage diffuser 246, i.e., diffuser spin, relative to the diffuser support ring 70 and lower pump intake mandrel 52. In one or more embodiments, the diffuser support ring 70 may be a bottom diffuser that is disposed between the lower pump mandrel 52 and the first stage diffuser 246.

Figure 6B:
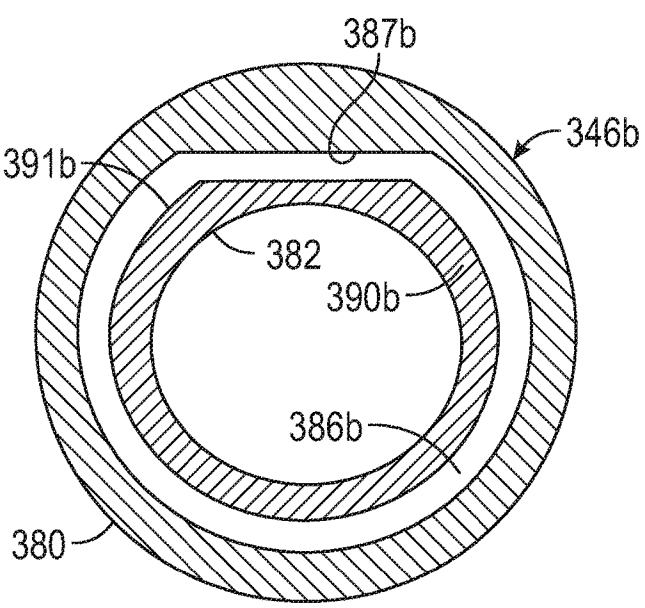
FIGS. 6A through 6C are cross sectional views of embodiments of lip orientation feature deployed in a recess orientation feature of adjacent diffusers.
Figure 6C:
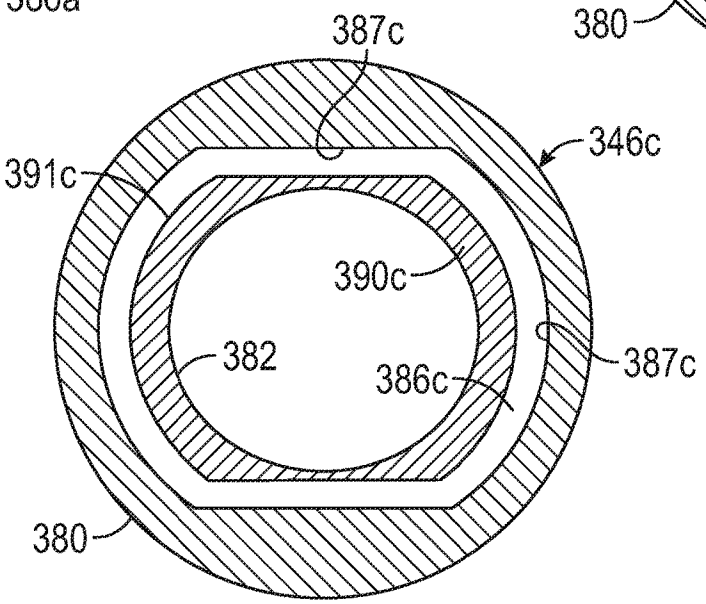
Figure 6A:
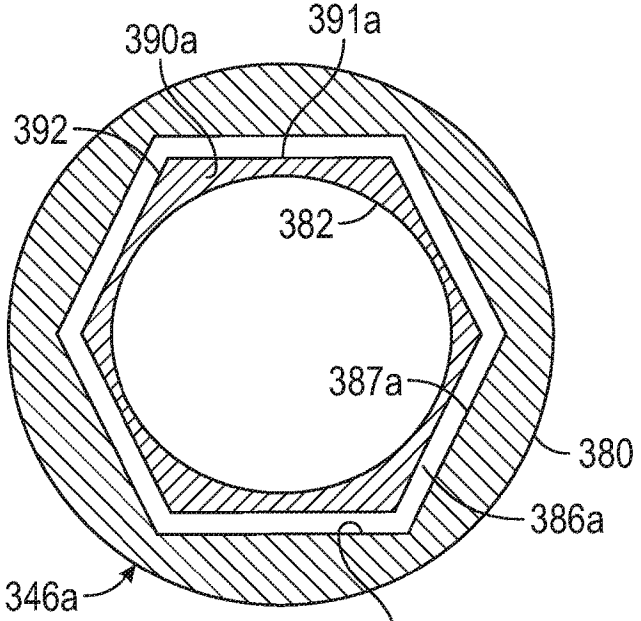

Referring to FIGS. 6A through 6C, cross sectional views of different embodiments of non-circular profiles of lip orientation features deployed in a recess orientation features of adjacent diffusers are illustrated. Stacked diffusers 346*a*, 346*b* and 346*c* include tubular walls 380 defining through bore 382 extending therethrough. A respective recess 386*a*, 386*b*, 386*c* defining a respective inner recess surface 387*a*, 387*b*, 387*c* and a respective lip 390*a*, 390*b*, 390*c* defining a respective lip outer perimeter surface 391*a*, 391*b* 391*c* is defined in the each of the diffusers 346*a*, 346*b* and 346*c*. In one or more embodiments (see FIG. 6A), the recess 386*a* and lip 396*c* define corresponding hexagonal profiles such that each of the flat surfaces define a recess orientation feature 388*a* or a lip orientation feature 392*a*. Interior angles of the hexagonal shapes defined by the inner recess surface 387*a* and the lip outer perimeter surface 391*a* may be equivalent, but the length of the sides of the lip outer perimeter surface 391 is smaller than a length of sides of the inner recess surface 387*a*. In some embodiments, at least one set of corresponding flat surfaces define a recess orientation feature 388*b* or a lip orientation feature 392*b* (see FIG. 6B). In some other embodiments, a plurality of spaced apart sets of corresponding flat surfaces define a recess orientation feature 388*c* or a lip orientation feature 392*c* (see FIG. 6C).

In some embodiments, the flat surfaces may be spaced apart from one another (see FIG. 6C) or they may intersect one another (see FIGS. 4B and 6A.). In one or more embodiments, the recess or lip may have a polygonal shape, such as the shown, e.g., in FIG. 3A, 4A, 4B, 5 and FIG. 6A. In one or more embodiments, the lip orientation feature may be at least one flat outer surface (see FIG. 6B), while in other embodiments, the orientation feature may be a plurality of flat outer surfaces (see FIG. 4A). The flat outer surfaces may be spaced apart from one another (see FIG. 6C) or they may intersect one another (see FIGS. 3A, 4A and 6A). In one or more embodiments, the lip may have a polygonal shape, such as the shown in FIGS. 3A, 4A and 6A. In other some other embodiments (not shown) non-circular profiles without any flat surfaces e.g., sets corresponding recesses and lips in an oval shape, may define recess and lip orientation features.

Figure 7A:
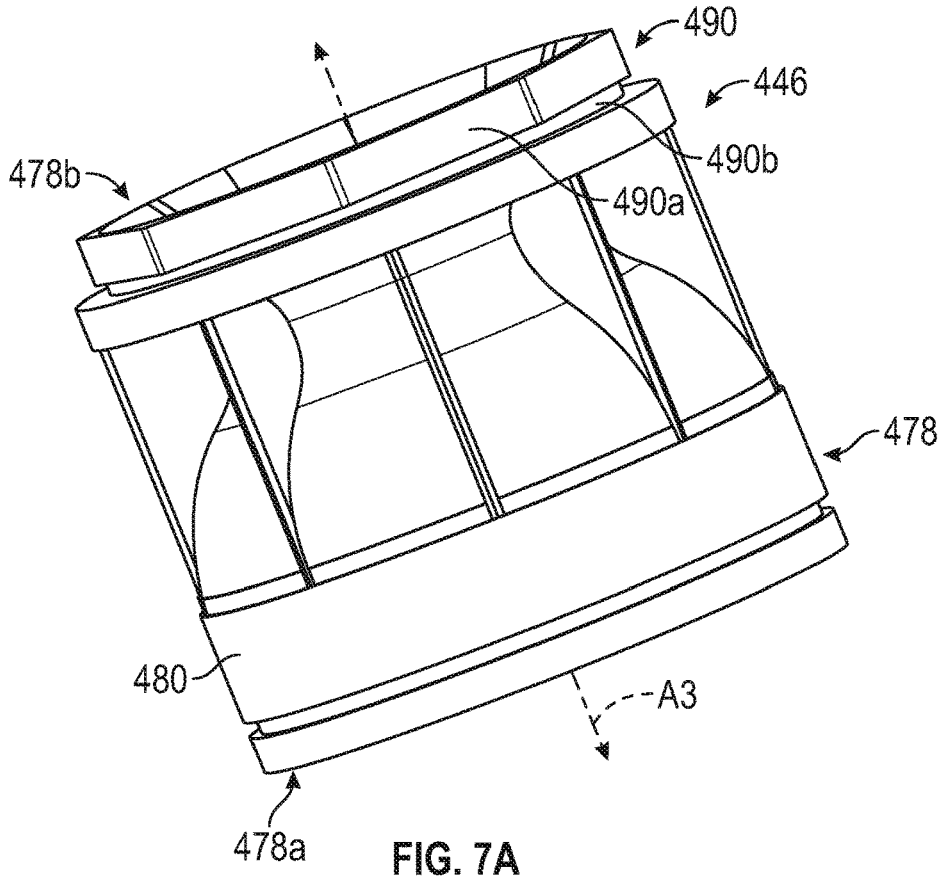
FIGS. 7A, 7B and 7C are isometric side, top and bottom views of another embodiment of a diffuser including an undercut centralizer.
Figure 7B:
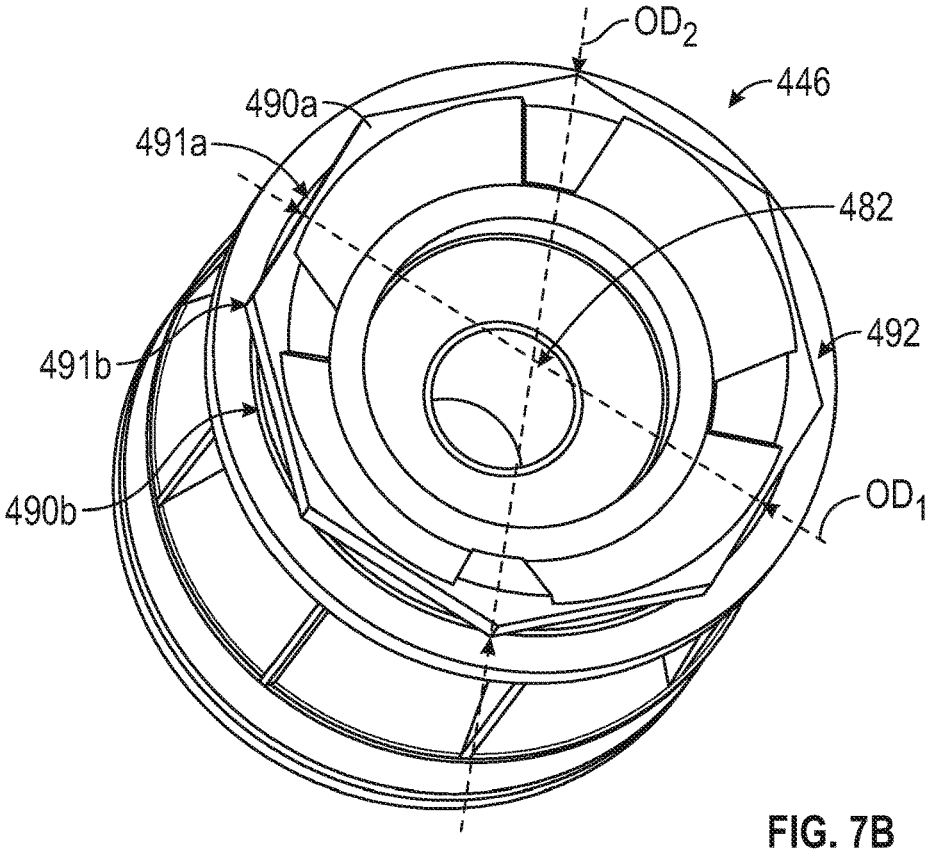
Figure 7C:
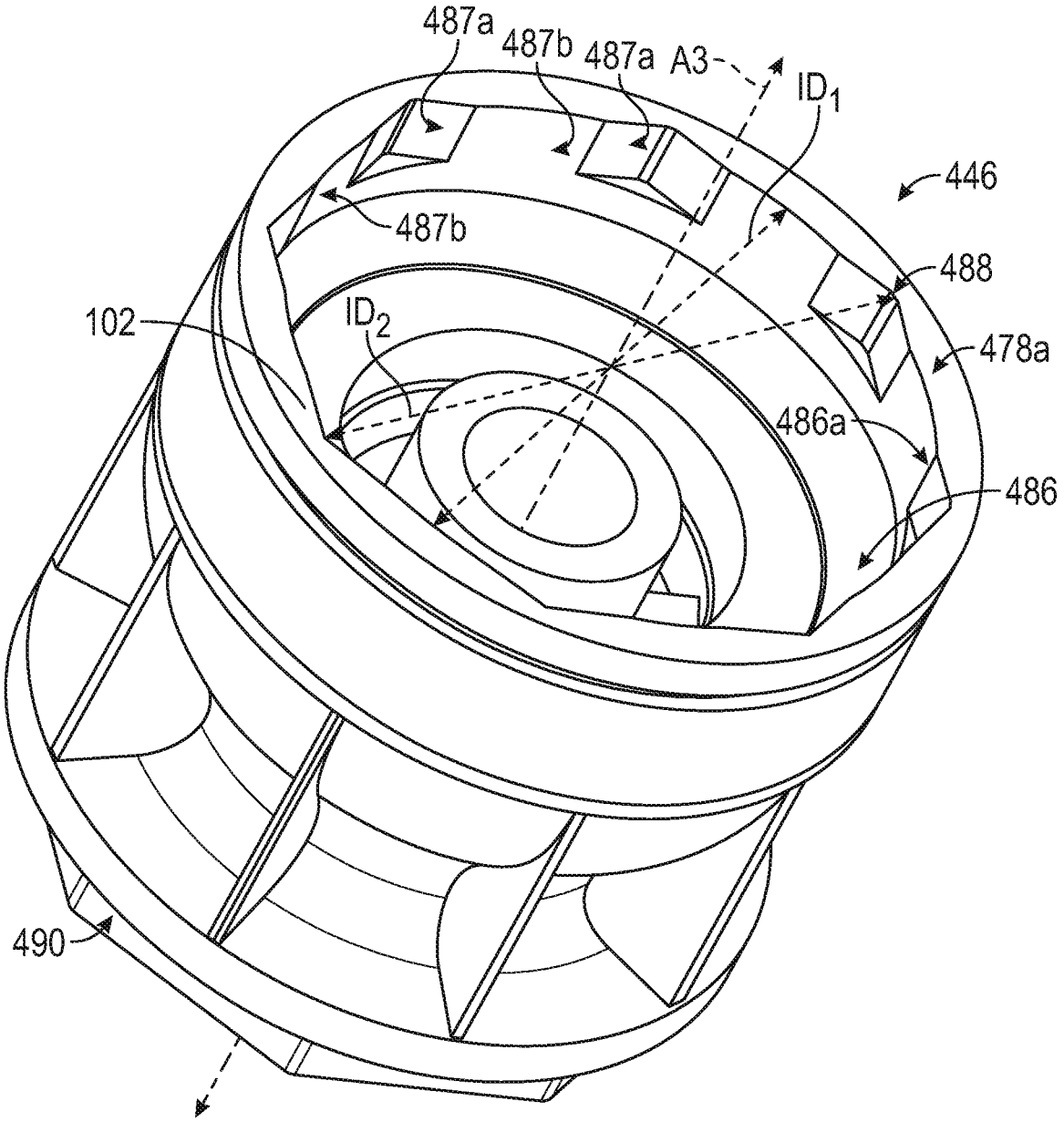

FIGS. 7A, 7B and 7C, are isometric views of a diffuser 446, in accordance with some other embodiments of the present disclosure. Diffuser 446 includes a cylinder 478 extending along a primary diffuser axis $A_3$. Cylinder 478 is formed of a tubular wall 480 with a through bore 482 extending between a first cylinder end 478*a* and a second cylinder end 478*b*.

A recess 486 (see FIG. 7C) is formed in the first cylinder end 478*a* and is characterized by a circumferential inner recess surface 486*a* fully or substantially circumscribing the primary diffuser axis $A_3$. The circumferential inner recess surface 486*a* defines a non-circular profile including eight (8) notches or internal corners 487*a* extending radially outwardly from a generally circular arcs 487*b*. The internal corners 487*a* may be considered recess orientation features 488 since a lip 490 of an adjacent diffuser 164 may engage the internal corners 487*a* to maintain a rotational orientation between the adjacent diffusers 164. The generally circular arcs 487*b* extending circumferentially between the corners 487*a* are centered about the primary diffuser axis $A_3$.

The lip 490 (see FIGS. 7A and 7B) projects axially from the second end 478*b* of the cylinder 478. Generally, the lip 490 may be formed of a wall defining a non-circular or polygonal first portion 490*a* and circular portion 490*b* on an outer surface thereof. The first portion 490*a* includes eight (8) flat faces 491*a* forming a polygon with eight (8) corners 491*b* defined by adjacent intersecting flat faces 491*a*. The second portion 490*a* is generally circular and is centered about the primary diffuser axis $A_3$. As best illustrated in FIG. 7B, the circular second portion 490*b* protrudes radially outward beyond the flat faces 491*a* of the first portion 490*a*, and the corners 491*b* of the first portion 490*a* protrude radially beyond the circular second portion 490*b*. The circular second portion 490*b* is undercut with respect to the corners 491*b*. As best illustrated in FIG. 7A, the polygonal first portion 490*a* and the circular second portion 490*b* are axially distinct portions of the lip 490, but in other embodiments may be combined to define a single circumferential profile circumscribing the primary diffuser axis $A_3$.

The lip 490 may be received into the recess 486 of an adjacent diffuser 446 in a diffuser stack (see FIG. 2) such that a rotational orientation between the diffusers 464 may be maintained. The corners 491*b* of the first portion 490*a* of the lip 490 may extend radially into the internal corners 487*a* of the inner recess surface 486*a*. Thus, when a differential torque is applied between the adjacent diffusers 446, the corners 491*b* of the lip 490 may engage the internal corners of the inner recess surface 486*a* to prevent relative rotation between the adjacent diffusers 446*a*. Thus, the corners 491*b* may be considered lip orientation features 492 corresponding to the recess orientation features 488.

The circular second portion 490*b* of the lip 490 may be received between the circular arcs 487*b* defined on the inner recess surface 486*a* to centralize adjacent diffusers 464 with respect to one another. A first outer diameter $OD_1$ of the circular second portion 490*b* may be sized so to fit closely within a first inner diameter of $ID_1$ of the circular arcs 487*b*. In some embodiments, a friction fit may be defined between the circular second portion 490*b* and the circular arcs 487*b* such that the primary diffuser axes $A_3$ of adjacent diffusers 464 are maintained in an aligned configuration with one another when the lip 490 is received in the recess 486. A greater clearance may be defined between a second outer diameter $OD_2$ and a second inner diameter $ID_2$ of the polygonal first portion 490*a* of the lip 490 and internal corners 487*a* of the internal recess surface 486*a* than between the first outer diameter $OD_1$ and the inner diameter of $ID_1$.

It has been observed that misalignment between the primary diffuser axes of adjacent diffusers can produce vibrations and between the diffusers in operation, which may interfere with the rotation of the impellers 62 (see FIG. 2) and the efficient operation of the pump. In some instances, the misalignment can cause adjacent diffusers to weld themselves together and/or the impellers to weld themselves to the diffusers. The centralizing engagement of the undercut circular second portion 490*b* with the circular arcs 487*b* of the inner recess surface 486*a* can prevent these difficulties.

Figure 8:
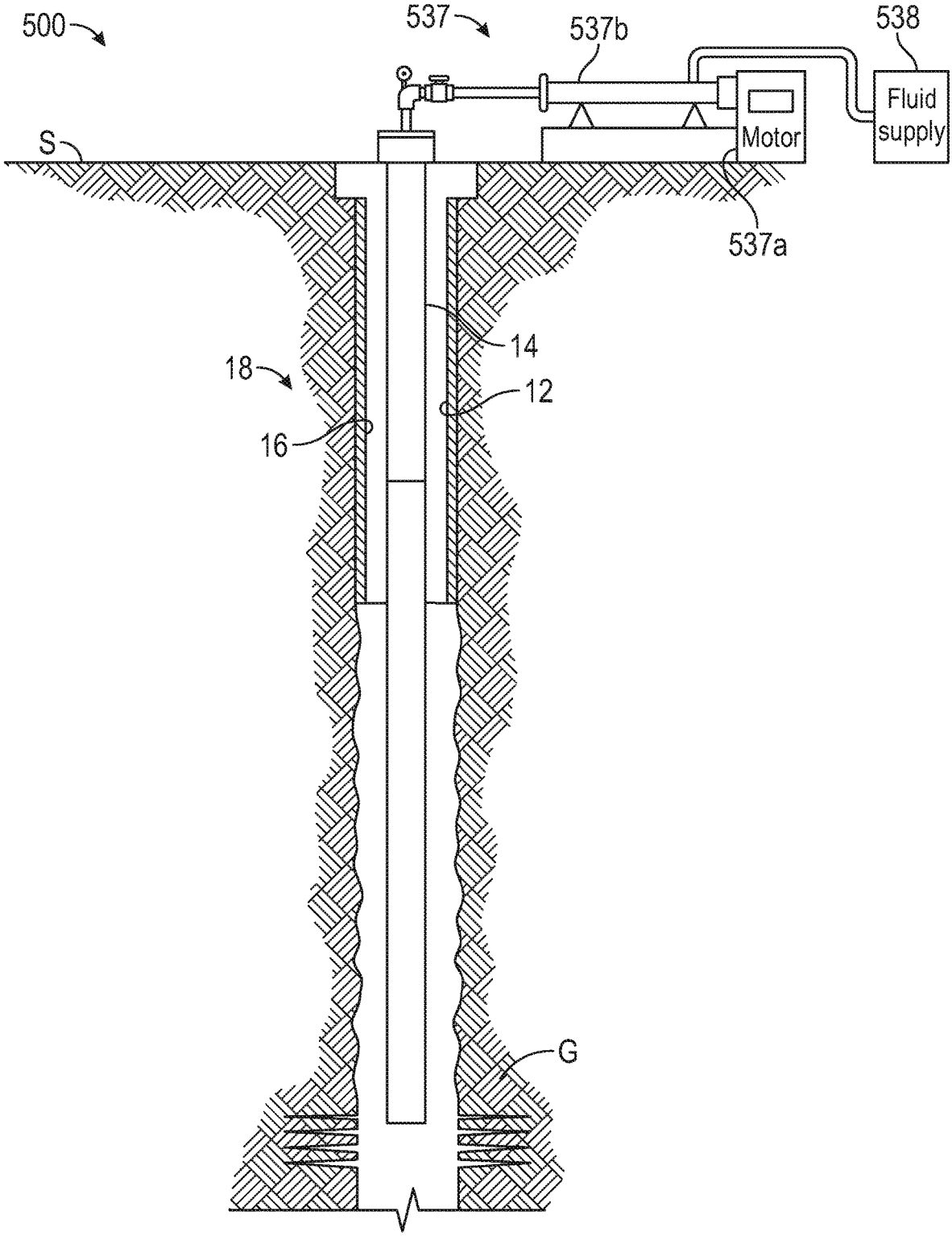
FIG. 8 is a partial cross-sectional side view of another wellbore system employing a surface pump that may include any of the diffusers of FIGS. 3A-7C.

Referring to FIG. 8, while the foregoing diffusers may have been generally described as a component of a pump deployed downhole in a wellbore or otherwise submerged in a wellbore, it will be appreciated that the pump may alternatively be utilized on the surface.

For example, many of the features described herein may also be employed in a wellbore system 500 with a surface pump system 537. The surface pump system 537 utilized on the surface location "S," and in some embodiments, the surface pump system 537 may be a horizontal pump system including a motor 537*a* and an elongated pump chamber 537*b* oriented generally horizontally on the surface location "S." The elongated pump chamber 537 may include any of diffusers described hereinabove, e.g., diffusers 46 (FIG. 3A), 146 (FIG. 4A), 246 (FIG. 5), 346*a*, 346*bg*, 346*c* (FIGS. 6A, 6B, 6C) and/or 446 (FIG. 7). As illustrated, the surface pump system 537 is arranged to intake fluid from a fluid supply 538 and discharge the fluid into the wellbore 12. Although not typical, in some other embodiments, the ESP 18 (FIG. 1) and the surface pump system 537 may be employed together to draw fluid from the wellbore 12, and in other embodiments, either the ESP 18 or the surface pump 537 may be employed individually without the other without departing from the scope of the disclosure.

It will further be appreciated that the diffusers as described herein are likewise an advancement over the art because the lip and recess design as described permit the diffusers, including the lip and the recess, to be readily manufactured entirely by casting, as opposed to the more expensive process of machining which is the typical way of manufacturing diffusers of the prior art.

Thus an electric submersible pump has been described. The electric submersible pump may include a pump housing; a shaft extending at least partially through the pump housing and adapted to be driven by a submersible motor; an impeller attached to the shaft and having an impeller passage for fluid to flow therethrough; a diffuser disposed adjacent and corresponding to the impeller to form a pump stage; wherein the diffuser comprises a cylinder formed of a tubular wall, with a through bore extending between a first cylinder end and a second cylinder end; a sleeve axially disposed within the cylinder along the bore; one or more helical diffuser vanes extending between the sleeve and the tubular wall of the cylinder; a recess formed in the first end of the cylinder, the recess having an inner recess surface along which is formed a recess orientation feature; and a lip projecting from the second cylinder end, the lip having an outer perimeter wall along which is formed a lip orientation feature. In other embodiments, a multi-stage pump stack may include a shaft; a diffuser disposed about the shaft; an impeller disposed within the diffuser; wherein the diffuser comprises a cylinder formed of a tubular wall, with a through bore extending between a first cylinder end and a second cylinder end; a sleeve axially disposed within the cylinder along the bore; one or more helical diffuser vanes extending between the sleeve and the tubular wall of the cylinder; a recess formed in the first end of the cylinder, the recess having an inner recess surface along which is formed a recess orientation feature; and a lip projecting from the second cylinder end, the lip having an outer perimeter wall along which is formed a lip orientation feature. Similarly, a multi-stage pump stack may include a shaft; a first diffuser disposed about the shaft; a first impeller disposed within the first diffuser; a second diffuser disposed about the shaft and adjacent to the first diffuser; and a second impeller disposed within the second diffuser, wherein each diffuser comprises a cylinder formed of a tubular wall, with a through bore extending between a first cylinder end and a second cylinder end; a sleeve axially disposed within the cylinder along the bore; one or more helical diffuser vanes extending between the sleeve and the tubular wall of the cylinder; a recess formed in the first end of the cylinder, the recess having an inner recess surface along which is formed a recess orientation feature; and a lip projecting from the second cylinder end, the lip having an outer perimeter wall along which is formed a lip orientation feature, wherein the lip of the first diffuser engages the recess of the second diffuser.

An electric pump includes a pump housing, a shaft extending at least partially through the pump housing and adapted to be driven by a electric motor, and first and second impellers attached to the shaft. Each impeller has an impeller passage for accelerating fluid flow therethrough. The pump further includes first and second diffusers disposed adjacent the first and second impellers, respectively, each of the first diffuser having a diffuser passage for decelerating the fluid an increasing a pressure of the fluid, wherein each of the diffuser comprises a cylinder defining a first cylinder end and a second cylinder end. A recess is formed in the first cylinder end of the first diffuser, the recess having a circumferential inner recess surface substantially circumscribing a primary diffuser axis and defining a non-circular profile along which is formed a recess orientation feature. A lip projects from the second cylinder end of the second diffuser into the recess, the lip having an outer perimeter substantially circumscribing the primary diffuser axis and defining a non-circular profile along which is formed a lip orientation feature, wherein the lip orientation feature extends radially into the recess orientation feature to prevent relative rotation between the first and second diffusers in response to a differential torque applied to the first and second diffusers about the primary diffuser axis.

Likewise, a diffuser for an electric submersible pump has been described. The diffuser for the electric submersible pump may include a cylinder formed of a tubular wall, with a through bore extending between a first cylinder end and a second cylinder end; a sleeve axially disposed within the cylinder along the bore; one or more helical diffuser vanes extending between the sleeve and the tubular wall of the cylinder; a non-circular recess formed in the first end of the cylinder, the recess having a recess surface; a lip projecting from the second cylinder end, the lip having an outer perimeter at least a portion of which has a shape that corresponds to the shape of the non-circular recess. Likewise, a diffuser may include a cylinder formed of a tubular wall, with a through bore extending between a first cylinder end and a second cylinder end; a sleeve axially disposed within the cylinder along the bore; one or more helical diffuser vanes extending between the sleeve and the tubular wall of the cylinder; a recess formed in the first end of the cylinder, the recess having an inner recess surface along which is formed a recess orientation feature; a lip projecting from the second cylinder end, the lip having an outer perimeter wall along which is formed a lip orientation feature. In other embodiments, a diffuser may include a cylinder formed of a tubular wall, with a through bore extending between a first cylinder end and a second cylinder end; a sleeve axially disposed within the cylinder along the bore; one or more helical diffuser vanes extending between the sleeve and the tubular wall of the cylinder; a recess formed in the first end of the cylinder, the recess having at least two surfaces, one of which is an orientation surface; a lip projecting from the second cylinder end, the lip having an outer perimeter at least a portion of which has a shape that corresponds to the shape of the shaped orientation surface.

A diffuser for an electric pump includes a cylinder formed of a tubular wall defining a primary diffuser axis, the cylinder including a through bore extending between a first cylinder end and a second cylinder end. A sleeve is axially disposed within the cylinder along the bore. One or more helical diffuser vanes extending between the sleeve and the tubular wall of the cylinder. A non-circular recess is formed in the first end of the cylinder, the recess having a recess surface substantially circumscribing the primary diffuser axis, and a lip projects from the second cylinder end, the lip having an outer perimeter at least a portion of which has a shape that corresponds to the shape of the non-circular recess.

For any one of the forgoing embodiments, one or more of the following elements may be included, alone or in combination with other elements:

At least three diffusers, wherein the lip of one diffuser engages the recess of an adjacent diffuser to form a diffuser stack.

The recess orientation feature is a notch.

The recess orientation feature is a shaped relief selected to correspond with a shaped protrusion forming the lip orientation feature.

The lip orientation feature is a shaped protrusion selected to correspond with a shaped relief forming the recess orientation feature.

The recess orientation feature is a plurality of notches.

The recess orientation feature is a plurality of notches symmetrically spaces about the recess.

At least two recess orientation features symmetrically spaced apart from one another about the recess.

The recess orientation feature is a flat surface.

The lip orientation feature comprises two intersecting flat surfaces of the outer perimeter wall.

The lip orientation feature is a protrusion extending from the outer perimeter wall.

At least two lip orientation features symmetrically spaced apart from one another about the perimeter wall.

A plurality of lip orientation features symmetrically spaced apart from one another about the perimeter wall.

The lip orientation feature is a flat surface.

The outer perimeter has at least one flat side and the orientation surface is flat.

The recess has two flat orientation surfaces and the outer perimeter has at least two flat sides.

The outer perimeter has a polygonal shape with at least three straight sides and an angle formed at the intersection of any two adjacent sides and the orientation surface of the recess forms a notch.

The outer perimeter has a polygonal shape with at least three straight sides and a corner formed at the intersection of any two adjacent sides.

The recess has a depth D and the lip has a height H and the lip height H is less than the recess depth D.

The recess of the first cylinder and the lip of the second cylinder are constructed of a cast material.

The pump is operably coupled to a tubing string extending into a wellbore.

The lip further includes a circular portion undercut with respect to corners of the polygonal shape defined by the lip and protruding radially beyond flat surfaces of the polygonal shape defined by the lip.

The inner recess surface of the first cylinder includes a circular arc centered on the primary diffuser axis and the lip of the second diffuser includes a centralizing circular portion centered on the primary diffuser axis when received by the circular arc A method of preventing diffuser spin in an electric pump includes constructing a first diffuser including a cylinder defining a recess therein, the recess having a circumferential inner recess surface substantially circumscribing a primary diffuser axis and defining a non-circular profile, constructing a second diffuser including a cylinder defining a lip projecting from an end thereof, the lip having an outer perimeter surface substantially circumscribing the primary diffuser axis and defining a non-circular profile, and stacking the first diffuser and second diffuser adjacent one another such that lip extends into the recess and such that the outer perimeter surface of the lip engages inner recess surface in response to a differential torque applied to the first and second diffusers about the primary diffuser axis.

A method of preventing diffuser spin in an electric pump includes (i) constructing a first diffuser including a cylinder defining a recess therein, the recess having a circumferential inner recess surface substantially circumscribing a primary diffuser axis and defining a non-circular profile (ii) constructing a second diffuser including a cylinder defining a lip projecting from an end thereof, the lip having an outer perimeter surface substantially circumscribing the primary diffuser axis and defining a non-circular profile, and (iii) stacking the first diffuser and second diffuser adjacent one another such that lip extends into the recess and such that a lip orientation feature of the outer perimeter surface of the lip extends radially into a recess orientation feature of the inner recess surface to engage the inner recess surface in response to a differential torque applied to the first and second diffusers about the primary diffuser axis.

The method may further include constructing the inner recess surface of the first diffuser and the outer perimeter surface of the second diffuser by casting a material of the first and second diffusers, centralizing the second diffuser with respect to the first diffuser by receiving a circular portion of the lip within a circular portion of the inner recess surface, and/or fluidly coupling the first and second diffusers to a production tubing string extending into the wellbore.

Although the present disclosure and its advantages have been described in detail, it should be understood that various changes, substitutions and alterations can be made herein without departing from the spirit and scope of the disclosure as defined by the following claims.

What is claimed is:

1. An electric pump, comprising:

a pump housing;

a shaft extending at least partially through the pump housing and adapted to be driven by an electric motor;

first and second impellers attached to the shaft, each impeller having an impeller passage for accelerating fluid flow therethrough;

first and second diffusers disposed adjacent the first and second impellers, respectively, each of the diffusers having a diffuser passage for decelerating the fluid and increasing a pressure of the fluid, wherein each of the diffusers comprises a cylinder defining a first cylinder end and a second cylinder end;

a recess formed in the first cylinder end of the first diffuser, the recess having a circumferential inner recess surface substantially circumscribing a primary diffuser axis and defining a non-circular profile along which is formed a recess orientation feature; and a lip projecting from the second cylinder end of the second diffuser into the recess, the lip having a non-circular outer perimeter substantially circumscribing the primary diffuser axis and defining a non-circular profile along which is formed a lip orientation feature, wherein the inner recess surface of the recess substantially circumscribes the outer perimeter of the lip, and wherein the lip orientation feature extends radially into the recess orientation feature to prevent relative rotation between the first and second diffusers in response to a differential torque applied to the first and second diffusers about the primary diffuser axis.

2. The pump according to claim 1, wherein the recess of the first cylinder and the lip of the second cylinder are constructed of a cast material.

3. The pump according to claim 1, wherein the inner recess surface of the first cylinder includes a circular arc centered on the primary diffuser axis and the lip of the second diffuser includes a centralizing circular portion centered on the primary diffuser axis when received by the circular arc.

4. The pump according to claim 1, wherein the inner recess surface and the outer perimeter of the lip each include at least one flat surface therealong.

5. The pump according to claim 4, wherein the inner recess surface and the outer perimeter of the lip each define a polygonal shape having a center located substantially at the primary diffuser axis.

6. The pump according to claim 1, wherein the recess has a depth and the lip has a height, and wherein the height of the lip is less than the depth of the recess.

7. The pump according to claim 1, further comprising a lip projecting from the second cylinder end of the first diffuser into a diffuser support ring.

8. The pump according to claim 7, wherein the lip of the first diffuser engages a recess orientation feature defined in the diffuser support ring to prevent relative rotation between the first diffuser and the diffuser support ring in response to a differential torque applied between the first diffuser and the diffuser support ring.

9. The pump according to claim 8, wherein the pump is operably coupled to a tubing string extending into a wellbore.

10. A diffuser for an electric pump, the diffuser comprising:

a cylinder formed of a tubular wall defining a primary diffuser axis, the cylinder including a through bore extending between a first cylinder end and a second cylinder end;

a sleeve axially disposed within the cylinder along the bore;

one or more helical diffuser vanes extending between the sleeve and the tubular wall of the cylinder;

a non-circular recess formed in the first end of the cylinder, the recess having a recess surface substantially circumscribing the primary diffuser axis; and a lip projecting from the second cylinder end, the lip having a non-circular outer perimeter disposed radially inward with respect to the recess surface such that the lip may be substantially circumscribed by an adjacent recess surface of an adjacent diffuser, at least a portion of the lip having a shape that corresponds to the shape of the non-circular recess.

11. The diffuser according to claim 10, wherein the cylinder is constructed entirely of a cast material.

12. The diffuser according to claim 10, wherein the lip substantially circumscribes the primary diffuser axis.

13. The diffuser according to claim 10, wherein the recess surface and the outer perimeter of the lip each include at least one flat surface therealong.

14. The diffuser according to claim 13, wherein the recess surface and the outer perimeter of the lip each define a polygonal shape.

15. The diffuser according to claim 14, wherein the lip further includes a circular portion undercut with respect to corners of the polygonal shape defined by the lip and protruding radially beyond flat surfaces of the polygonal shape defined by the lip.

16. The diffuser according to claim 10, wherein the recess surface includes a plurality of radially extending notches symmetrically spaced about the recess.

17. A method of preventing diffuser spin in an electric pump, the method comprising:

constructing a first diffuser including a cylinder defining a recess therein, the recess having a circumferential inner recess surface substantially circumscribing a primary diffuser axis and defining a non-circular profile;

constructing a second diffuser including a cylinder defining a lip projecting from an end thereof, the lip having a non-circular outer perimeter surface substantially circumscribing the primary diffuser axis and defining a non-circular profile; and stacking the first diffuser and second diffuser adjacent one another such that lip extends into the recess such that the inner recess surface of the recess substantially circumscribes the outer perimeter surface of the lip and such that a lip orientation feature of the outer perimeter surface of the lip extends radially into a recess orientation feature of the inner recess surface to engage the inner recess surface in response to a differential torque applied to the first and second diffusers about the primary diffuser axis.

18. The method according to claim 17, further comprising constructing the inner recess surface of the first diffuser and the outer perimeter surface of the second diffuser by casting a material of the first and second diffusers.

19. The method according to claim 17, further comprising centralizing the second diffuser with respect to the first diffuser by receiving a circular portion of the lip within a circular portion of the inner recess surface.

20. The method according to claim 17, further comprising fluidly coupling the first and second diffusers to a production tubing string extending into the wellbore.

* * * * *